US011519083B1

(12) United States Patent
Yan et al.

(10) Patent No.: US 11,519,083 B1
(45) Date of Patent: Dec. 6, 2022

(54) METHOD FOR PREPARING PRODUCTS BY ELECTROCHEMICAL REDUCTIVE AMINATION AND SIMULTANEOUS OXIDATION OF ALDEHYDE-BASED BIOMASS USING NON-PRECIOUS METAL CATALYSTS

(71) Applicant: SUN YAT-SEN UNIVERSITY, Guangzhou (CN)

(72) Inventors: Kai Yan, Guangzhou (CN); Man Zhang, Shangqiu (CN); Huixia Luo, Guangzhou (CN)

(73) Assignee: SUN YAT-SEN UNIVERSITY, Guangzhou (CN)

( * ) Notice: Subject to any disclaimer, the term of this patent is extended or adjusted under 35 U.S.C. 154(b) by 0 days.

(21) Appl. No.: 17/853,868

(22) Filed: Jun. 29, 2022

(30) Foreign Application Priority Data

Sep. 13, 2021 (CN) ..... 202111066270.9

(51) Int. Cl.

| | |
|---|---|
| ***C25B 3/05*** | (2021.01) |
| ***C25B 3/07*** | (2021.01) |
| ***C25B 3/09*** | (2021.01) |
| ***C25B 3/23*** | (2021.01) |
| ***C25B 3/25*** | (2021.01) |

(52) U.S. Cl.
CPC ..... *C25B 3/25* (2021.01); *C25B 3/07* (2021.01); *C25B 3/23* (2021.01)

(58) Field of Classification Search
CPC .... C25B 3/05; C25B 3/09; C25B 3/23; C25B 3/25; C25B 3/07
USPC ..... 205/422, 427
See application file for complete search history.

(56) References Cited

U.S. PATENT DOCUMENTS

2018/0057949 A1 3/2018 Choi et al.

FOREIGN PATENT DOCUMENTS

CN 111472020 A 7/2020

OTHER PUBLICATIONS

Zhong et al., "Electrodeposition of Hybrid Nanosheet-Structured NiCo2O4 on Carbon Fiber Paper as a Non-Noble Electrocatalyst for Efficient Electrooxidation of 5-Hydroxymethylfurfural to 2,5-Furandicarboxylic Acid," New Journal of Chemistry (2021), vol. 45, No. 25, pp. 11213-11221. (Year: 2021).*

Yang et al., "Electrochemical Oxidation of Biomass Derived 5-Hydroxymethylfurfural (HMF): Pathway, Mechanism, Catalysts and Coupling Reactions," Green Chemistry (2021), vol. 23, No. 12, pp. 4228-4254. (Year: 2021).*

Chu Daobao et al., "Heterogeneous Electrocatalytic Reduction of furfural by NanoTi02-CNT Composite Membrane Electrode in DMF Solution", Journal of Physical Chemistry, vol. 22, pp. 373-377.

CNIPA, Notification of a First Office Action for CN202111066270.9, dated Mar. 4, 2022.

Sun Yat-sen University (Applicant), Reply to Notification of a First Office Action for CN202111066270.9, w/ replacement claims, dated Mar. 16, 2022.

Sun Yat-sen University (Applicant), Supplemental Reply to Notification of a First Office Action for CN202111066270.9, w/ allowed replacement claims and replacement specification, dated Apr. 6, 2022.

CNIPA, Notification to grant patent right for invention for CN202111066270.9, dated Apr. 14, 2022.

* cited by examiner

*Primary Examiner* — Edna Wong
(74) *Attorney, Agent, or Firm* — Hemisphere Law, PLLC; Zhigang Ma

(57) ABSTRACT

A method for preparing products by electrochemical reductive amination and simultaneous oxidation of aldehyde-based biomass using non-precious metal catalysts is provided, which relates to a field of electrocatalysis. The preparing method includes: performing an electrochemical reaction in an electrolytic system with room temperature and atmospheric pressure (at a range of 25° C. to 30° C., 101 kPa) by taking an aldehyde compound and an amine compound as raw materials for reductive amination and oxidation of aldehyde-based biomass, and thereby obtaining the products. The electrolytic system includes a reaction substrate, an electrolyte, a solvent, an anode and a cathode. The anode is a phosphorylated hydrotalcite catalyst and the cathode is a Ti-based catalyst. The method uses no external oxidants and precious metal catalysts, which is clean, environmental and efficient.

10 Claims, No Drawings

METHOD FOR PREPARING PRODUCTS BY ELECTROCHEMICAL REDUCTIVE AMINATION AND SIMULTANEOUS OXIDATION OF ALDEHYDE-BASED BIOMASS USING NON-PRECIOUS METAL CATALYSTS

TECHNICAL FIELD

The disclosure relates to a field of electrocatalysis, more particularly to a method for preparing products by electrochemical reductive amination (also referred to as borch reduction) and simultaneous oxidation of aldehyde-based biomass using non-precious metal catalysts.

BACKGROUND

Since the mid-20th century, Borch and coworkers have been using stoichiometric sodium borohydride ($NaBH_4$) and sodium triacetoxyborohydride ($NaBH_3CN$) as strong reductants for reductive amination. Later, hydrosilane gradually became a more stable and effective reductant. Although an application of the above reductants in reductive amination requires high-temperature and high-pressure, there is no use of inert atmosphere or dry solvent. In response to green chemistry, hydrogen has been widely used in a research of various transition metal-catalyzed or Lewis acid-catalyzed reductive amination in recent years, but the research usually requires high pressure. Moreover, these outstanding researches mainly use a precious metal catalyst, but due to high cost and scarcity of resources hinder a development of aminated derivatives. Furthermore, a precious metal catalytic process commonly uses hazardous gases and toxic reagents under high-temperature and high-pressure, which is of high energy consumption and harmful to the environment. To develop greener and more sustainable methods for amine synthesis, researchers are turning to develop a non-precious metal catalytic system, and use low cost and readily available reaction material and less toxic solvent in simple and mild reaction conditions.

SUMMARY

An object of the disclosure is to overcome disadvantages of the related art in the above background and provides a method for preparing products by electrochemical reductive amination and simultaneous oxidation of aldehyde-based biomass using non-precious metal catalysts, which uses no external oxidant and precious metal catalyst, and is clean, environmental and efficient.

To achieve the object of the disclosure, the method for preparing products by electrochemical reductive amination and simultaneous oxidation of aldehyde-based biomass using non-precious metal catalysts includes: performing an electrochemical reaction in an electrolytic system with room temperature and atmospheric pressure (at a range of 25° C. to 30° C., 101 kPa) by taking an aldehyde compound and an amine compound as raw materials for reductive amination and oxidation of aldehyde-based biomass, and thereby obtaining the products. The electrolytic system includes a reaction substrate, an electrolyte, a solvent, an anode and a cathode. The anode is a phosphatized hydrotalcite catalyst (such as one of phosphatized nickel-cobalt layered double hydroxides (P—NiCo-LDHs) and phosphatized nickel-ferrum layered double hydroxides (P—NiFe-LDHs) and the cathode is a Ti-based catalyst.

In an embodiment of the disclosure, the aldehyde compound is the reaction substrate, which is at least one of furfural, 5-hydroxymethyl furfural, 5-methyl furfural, benzaldehyde and vanillin.

In an embodiment of the disclosure, the electrolyte includes a cathode electrolyte; the cathode electrolyte is at least one of methylamine, ethylamine and ethanolamine.

In an embodiment of the disclosure, the electrolyte includes an anode electrolyte; the anode electrolyte is at least one of sodium hydroxide and potassium hydroxide.

In an embodiment of the disclosure, the solvent is ultrapure water (also referred to as primary water).

In an embodiment of the disclosure, the Ti-based catalyst is one or more of $TiS_2$ and titanium metal-organic framework (Ti-MOF).

In an illustrated embodiment of the disclosure, the anode is the P—NiCo-LDHs catalyst.

In an embodiment of the disclosure, a molar ratio of the aldehyde compound to the electrolyte is 1:0.5 to 1:10.

In an embodiment of the disclosure, a voltage of the electrochemical reaction is at a range of −0.6 V vs. reversible hydrogen electrode (RHE) to 1.5 V vs. RHE, that is, the voltage of the electrochemical reaction relative to the RHE is at the range from −0.6 V to 1.5 V.

In an embodiment of the disclosure, a temperature of the electrochemical reaction is at a range of 25° C. to 40° C.; in an illustrated embodiment of the disclosure, the temperature of the electrochemical reaction is at room temperature.

In an embodiment of the disclosure, a reaction time of the electrochemical reaction is at a range of 3 hours to 18 hours; in an illustrated embodiment, the reaction time of the electrochemical reaction is at a range of 3 hours to 5 hours.

In an embodiment of the disclosure, the amine compound is obtained after neutralization after an end of the electrochemical reaction by high-performance liquid chromatography using ammonium formate and methanol mobile phase analysis. The anode oxidation compound is obtained after neutralization after an end of the electrochemical reaction by high-performance liquid chromatography using ultrapure water and methanol mobile phase analysis.

Compared with the related art, the method of the disclosure uses no external oxidant and precious metal catalyst, and has advantages of simple and mild conditions, low waste, good tolerance of functional groups and high yield, which is clean, environmental and efficient. In addition, the method can simultaneously realize bipolar reaction to prepare oxidation and amination of two kinds of high value added products, which can be used in a large-scale industrial production.

DETAILED DESCRIPTION OF EMBODIMENTS

In order to make the object, technical solutions and advantages of the disclosure clearer, the disclosure is further explained in conjunction with specific embodiments. Additional aspects and advantages of the disclosure will be explained partly as follows, some of which will become apparent from a following description, or from a practice of the disclosure. It should be understood that the specific embodiments are only used to explain the disclosure and are not used to limit the disclosure.

As used herein, terms “contain”, “include”, “comprise”, “compose” or any other variation are intended to cover, a non-exclusive inclusion. For example, a composition, a step, a method, a product, or a device including listed elements need not be limited to only the above elements but can include other elements not expressly listed or inherent in the composition, the step, the method, the product or the device.

When an amount, concentration, or other value or parameter is expressed as a range, an illustrated range, or a series of upper illustrated range and lower illustrated range, it should be understood that all ranges formed by any pairing of any upper range or illustrated value with any lower range or illustrated value are disclosed, regardless of whether the range is disclosed separately. For example, when disclosing a range of 1 to 5, the range should be interpreted to include a range of 1 to 4, a range of 1 to 3, a range of 1 to 2, a range of 1 to 2 and a range of 4 to 5, a range of 1 to 3 and 5, etc. When a range of value is described herein, unless otherwise explained, the range is intended to include an end value and all integers and fractions within the range.

Indefinite articles "one kind" and "one" before elements or components of the disclosure do not limit a quantity of elements or components (i.e. the number of occurrences). Therefore, the indefinite articles "one kind" and "one" should be understood as including one or at least one. In addition, elements or components in a singular form also include a plural form, unless the number explained clearly refers only to the singular form.

In addition, terms "an embodiment", "some embodiments", "example", "specific example", and "some examples" are meant to describe specific feature, structure, material, or characteristic that are included in at least one embodiment or example of the disclosure in conjunction with specific embodiment or example. In this summary, indicative representation of the above terms is not necessarily directed to a same embodiment or example. Furthermore, technical features involved in each embodiment of the disclosure can be combined with each other as long as there is no conflict between them.

Embodiment 1

Adding 0.7 mol/L (M) ethanolamine electrolyte and 0.1 M furfural to a four-necked round-bottom flask; using Ti-MOF as the cathode and P—NiCo-LDHs as the anode; performing an electrochemical reaction in Autlab M204 electrochemical workstation, stirring at room temperature and atmospheric pressure (at a range of 25° C. to 30° C., 101 kPa) for reductive amination and electrochemical oxidation for 4 hours at a constant voltage of −0.5 V vs. RHE, thereby obtaining 91% conversion of furfural, and a selectivity of the amine compound 2-furanmethanol 5-(dimethylamino) methyl obtained after neutralization by high-performance liquid chromatography using ammonium formate and methanol mobile phase analysis is 99%.

Embodiment 2

Adding 0.1 M sodium hydroxide and 0.1 M 5-hydroxymethyl furfural to a four-necked round-bottom flask; using $TiS_2$ as the cathode and P—NiFe-LDHs as the anode; performing an electrochemical reaction in Autlab M204 electrochemical workstation, stirring at room temperature and atmospheric pressure (at a range of 25° C. to 30° C., 101 kPa) for reductive amination and electrochemical oxidation for 4 hours at a constant voltage of 1.5 V vs. RHE, thereby obtaining 70% conversion of 5-hydroxymethyl furfural, and a selectivity of the oxide furan-2,5-dicarboxylic acid obtained after neutralization by high-performance liquid chromatography using ultrapure water and methanol mobile phase analysis is 60%.

Embodiment 3

Adding 0.7 M ethanolamine electrolyte and 0.1 M 5-hydroxymethyl furfural to a four-necked round-bottom flask; using $TiS_2$ as the cathode and P—NiCo-LDHs as the anode; performing an electrochemical reaction in Autlab M204 electrochemical workstation, stirring at room temperature and atmospheric pressure (at a range of 25° C. to 30° C., 101 kPa) for reductive amination and electrochemical oxidation for 4 hours at a constant voltage of −0.6 V vs. RHE to obtain 91% conversion of 5-hydroxymethyl furfural, and a selectivity of the amine compound 2-furanmethanol 5-(dimethylamino)methyl obtained after neutralization by high-performance liquid chromatography using ammonium formate and methanol mobile phase analysis is 99%.

Embodiment 4

Adding 0.1 M sodium hydroxide and 0.1 M 5-hydroxymethyl furfural to a four-necked round-bottom flask; using $TiS_2$ as the cathode and P—NiFe-LDHs as the anode; performing an electrochemical reaction in Autlab M204 electrochemical workstation, stirring at room temperature and atmospheric pressure (at a range of 25° C. to 30° C., 101 kPa) for reductive amination and electrochemical oxidation for 4 hours at a constant voltage of 1.5 V vs. RHE to obtain 85% conversion of 5-hydroxymethyl furfural, and a selectivity of the oxide furan-2,5-dicarboxylic acid obtained after neutralization by high-performance liquid chromatography using ultrapure water and methanol mobile phase analysis is 72%.

It is easy for those skilled in the art to understand that the above description is only the exemplary embodiments of the disclosure, but the protection scope of the disclosure is not limited to this. Any amendment, equivalent replacement and improvement made within the spirit and principles of the disclosure shall be included in the scope of protection of the disclosure.

What is claimed is:

1. A method for preparing products by electrochemical reductive amination and simultaneous oxidation of aldehyde-based biomass using non-precious metal catalysts, comprising:

performing an electrochemical reaction in an electrolytic system with atmospheric pressure by taking an aldehyde compound and an amine compound as raw materials for the electrochemical reductive amination and simultaneous oxidation of aldehyde-based biomass, and thereby obtaining the products;

wherein the electrolytic system comprises: a reaction substrate, an electrolyte, a solvent, an anode and a cathode;

wherein for the simultaneous oxidation of aldehyde-based groups biomass, the cathode is a $TiS_2$ catalyst;

wherein the anode is a phosphated nickel-cobalt layered double hydroxides (P—NiCo-LDHs) catalyst; the aldehyde compound is the reaction substrate, comprises: 5-hydroxymethyl furfural; and the electrolyte comprises an anode electrolyte and a cathode electrolyte.

2. The method according to claim 1, wherein the solvent is ultrapure water.

3. The method according to claim 1, wherein the cathode electrolyte is at least one of methylamine, ethylamine and ethanolamine.

4. The method according to claim 1, wherein the anode electrolyte is at least one of sodium hydroxide and potassium hydroxide.

5. The method according to claim 1, wherein a molar ratio of the aldehyde compound to the anode electrolyte is 1:0.5 to 1:10.

6. The method according to claim 1, wherein a voltage of the electrochemical reaction relative to a reversible hydrogen electrode (RHE) is at a range from −0.6 V to 1.5 V.

7. The method according to claim 1, wherein a temperature of the electrochemical reaction is at a range from 25° C. to 40° C.

8. The method according to claim 1, wherein a temperature of the electrochemical reaction is at room temperature.

9. The method according to claim 1, wherein a reaction time of the electrochemical reaction is at a range from 3 hours to 18 hours.

10. The method according to claim 1, wherein a reaction time of the electrochemical reaction is at a range from 3 hours to 5 hours.

* * * * *